US011825917B1

(12) United States Patent
Wu

(10) Patent No.: US 11,825,917 B1
(45) Date of Patent: Nov. 28, 2023

(54) MULTI-POINT BUCKLE

(71) Applicant: TAIWAN RACING PRODUCTS CO., LTD., Dacun Township, Changhua County (TW)

(72) Inventor: Wen-Yuan Wu, Dacun Township, Changhua County (TW)

(73) Assignee: TAIWAN RACING PRODUCTS CO., LTD., Dacun Township (TW)

( * ) Notice: Subject to any disclaimer, the term of this patent is extended or adjusted under 35 U.S.C. 154(b) by 0 days.

(21) Appl. No.: 17/992,903

(22) Filed: Nov. 22, 2022

(51) Int. Cl.
*A44B 11/20* (2006.01)

(52) U.S. Cl.
CPC ..... *A44B 11/20* (2013.01)

(58) Field of Classification Search
CPC ..... A44B 11/20
See application file for complete search history.

(56) References Cited

U.S. PATENT DOCUMENTS 3,825,979 A * 7/1974 Jakob ..... A44B 11/2534 24/579.11
4,646,400 A * 3/1987 Tanaka ..... A44B 11/2549 24/632
5,182,837 A * 2/1993 Anthony ..... A44B 11/2561 24/642
5,267,377 A * 12/1993 Gillis ..... A44B 11/2511 24/641
5,606,783 A * 3/1997 Gillis ..... A44B 11/2549 24/628
5,813,097 A * 9/1998 Woellert ..... A44B 11/2549 24/642
7,093,331 B1 * 8/2006 Holmberg ..... A44B 11/2546 24/633
7,600,302 B2 * 10/2009 Dillner ..... A44B 11/2523 24/615
7,849,571 B2 * 12/2010 Chen ..... A44B 11/2549 24/579.11
8,256,073 B2 * 9/2012 Zhang ..... A44B 11/266 297/483
8,448,308 B2 * 5/2013 Mountz ..... B60N 2/2812 24/615
8,720,019 B2 * 5/2014 Buckingham ..... A44B 11/2511 24/632
9,545,133 B1 * 1/2017 Wu ..... A44B 11/2542
11,653,721 B2 * 5/2023 Jessup ..... A44B 11/2503 24/629
2002/0089228 A1 * 7/2002 Takayama ..... B60N 2/2812 297/484
2010/0264707 A1 * 10/2010 Tang ..... B60N 2/2812 24/593.1
2018/0078001 A1 * 3/2018 Babin ..... A44B 11/2511

* cited by examiner

*Primary Examiner* — David M Upchurch

(57) ABSTRACT

A multi-point buckle has a buckle, at least two latches and a plurality of dust jackets. The buckle has a plurality of tongue slots on a peripheral edge. Each of the latches has at least two tongues, and each tongue is capable of being inserted into one of the tongue slots of the buckle for locking. Each dust jacket has a through slot through two opposite ends for accepting one of the tongues. One of the two opposite ends of the dust jacket is a first abutting end, the first abutting end abutting an edge of the buckle when the one of the tongues and a corresponding tongue slot are locked together, and the first abutting end has a loop lip around an opening of the through slot for filling in between the tongue and the tongue slot and prevent dust from entering.

5 Claims, 9 Drawing Sheets

MULTI-POINT BUCKLE

BACKGROUND OF INVENTION

Field of Invention

The present invention relates to a multi-point buckle, and more particularly to a multi-point buckle capable of preventing from dust.

Description of the Related Art

In order to ensure the safety of the drivers and the passengers in the vehicle, among the standard equipment of the vehicle, the safety belt is a necessary basic equipment in the car. However, the applications of the vehicle are quite extensive now, such as off-road vehicles or all-terrain vehicles . . . etc. which frequently driving in sandy or muddy environment even wading streams and other unfavorable environments, so that sand or dust can easily invade the car. Seat belts used to fix the driver and passengers in the car attached to the latch are inserted into the jack of the buckle, however there is still a gap between the jack of the buckle and the latch, so when sand or dust invades the car, it is easy to further enter through the gap formed between the jack of the buckle and the latch. Once the silt or sand falls into the buckle, because the buckle does not have the function of discharging silt or sand, the silt or sand accumulates in the buckle, which affects the locking mechanism of the buckle. With the enough accumulation of the foreigner objects, the components of the locking structure cannot operate normally, so it affects the securing function of the buckle and the latch, and loses the function of protecting the driver and passengers.

Therefore, it is desirable to provide a multi-point buckle to mitigate and/or obviate the aforementioned problems.

SUMMARY OF THE INVENTION

An objective of present invention is to provide a multi-point buckle which is capable of improving the above-mention problems.

In order to achieve the above mentioned objective, a multi-point buckle has a buckle, at least two latches and a plurality of dust jackets. The buckle has a plurality of tongue slots on a peripheral edge. Each of the latches has at least two tongues, and each tongue is capable of being inserted into one of the tongue slots of the buckle for locking. Each dust jacket has a through slot through two opposite ends for accepting one of the tongues. One of the two opposite ends of the dust jacket is a first abutting end, the first abutting end abutting an edge of the buckle when the one of the tongues and a corresponding tongue slot are locked together, and the first abutting end has a loop lip around an opening of the through slot for filling in between the tongue and the tongue slot and prevent dust from entering.

Other objects, advantages, and novel features of invention will become more apparent from the following detailed description when taken in conjunction with the accompanying drawings.

DETAILED DESCRIPTION OF THE PREFERRED EMBODIMENT

Figure 1:
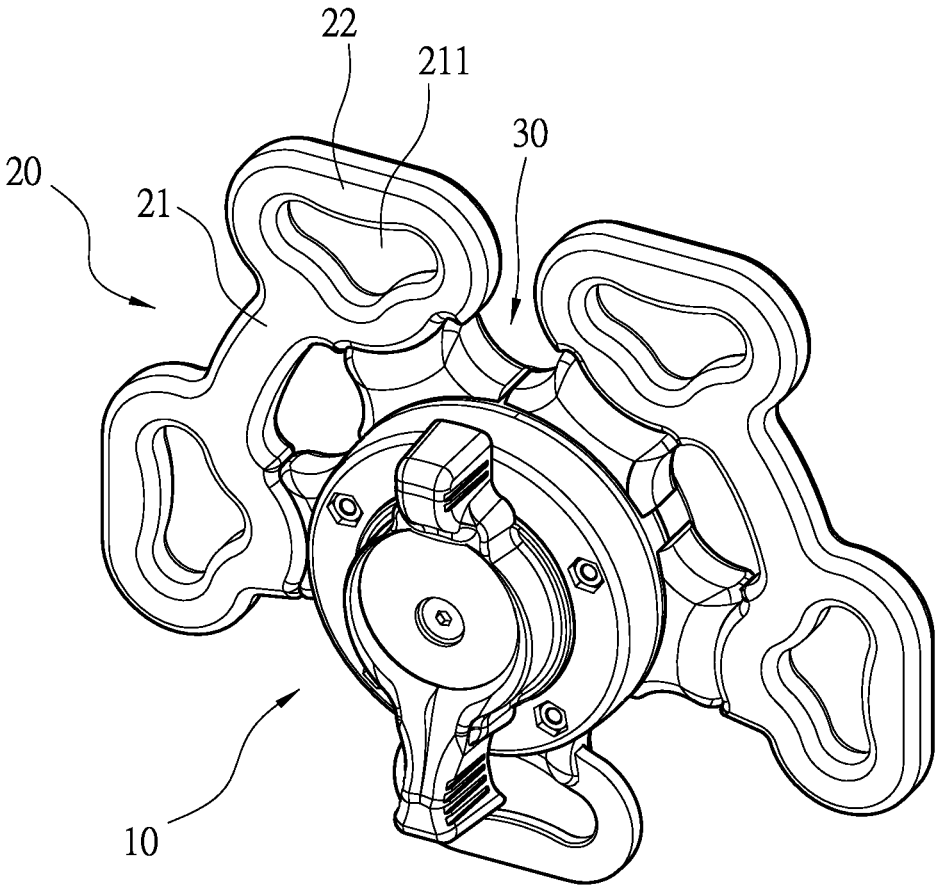
FIG. 1 is a three-dimensional combined view of a preferred embodiment according to the present invention.
Figure 2:
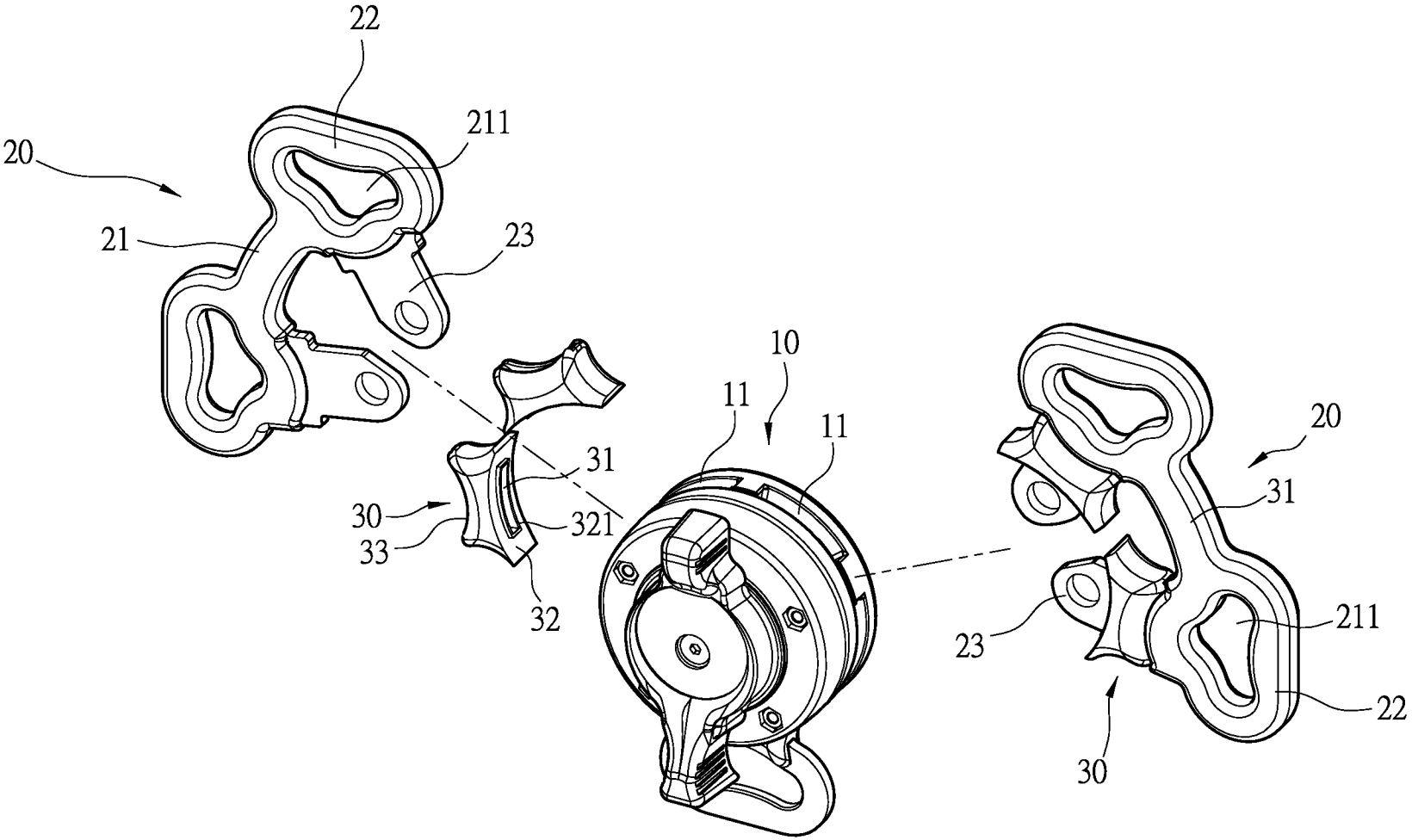
FIG. 2 is a three-dimensional exploded view of the preferred embodiment according to the present invention.
Figure 3:
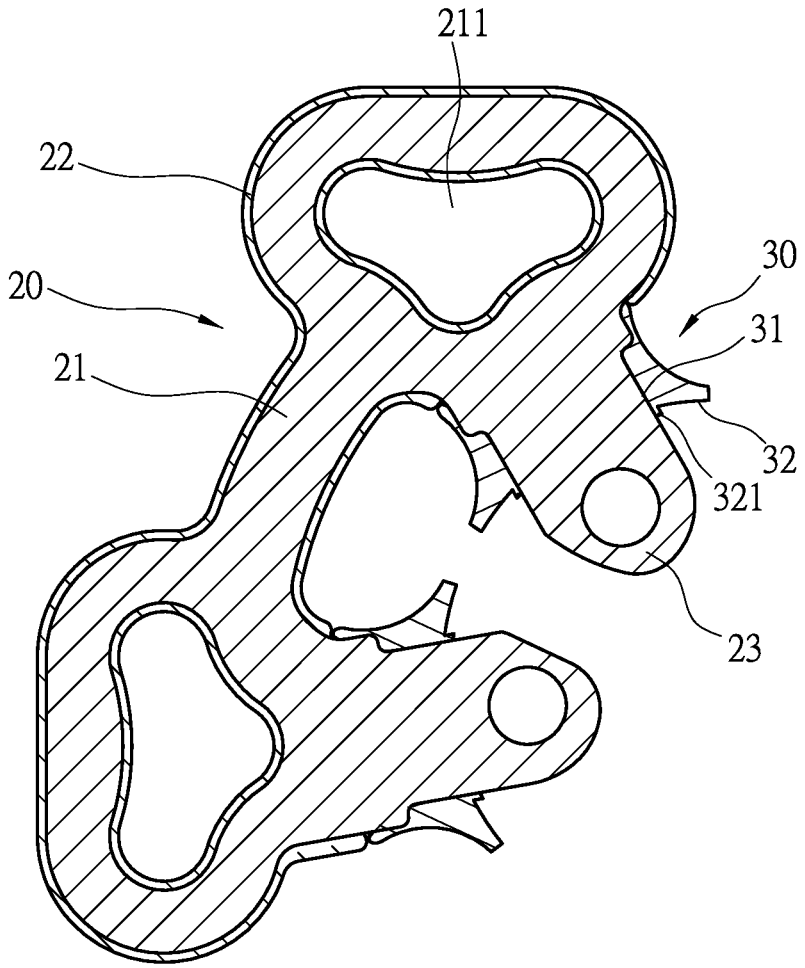
FIG. 3 is a cross-sectional view of the preferred embodiment according to the preferred embodiment of the present invention.
Figure 4:
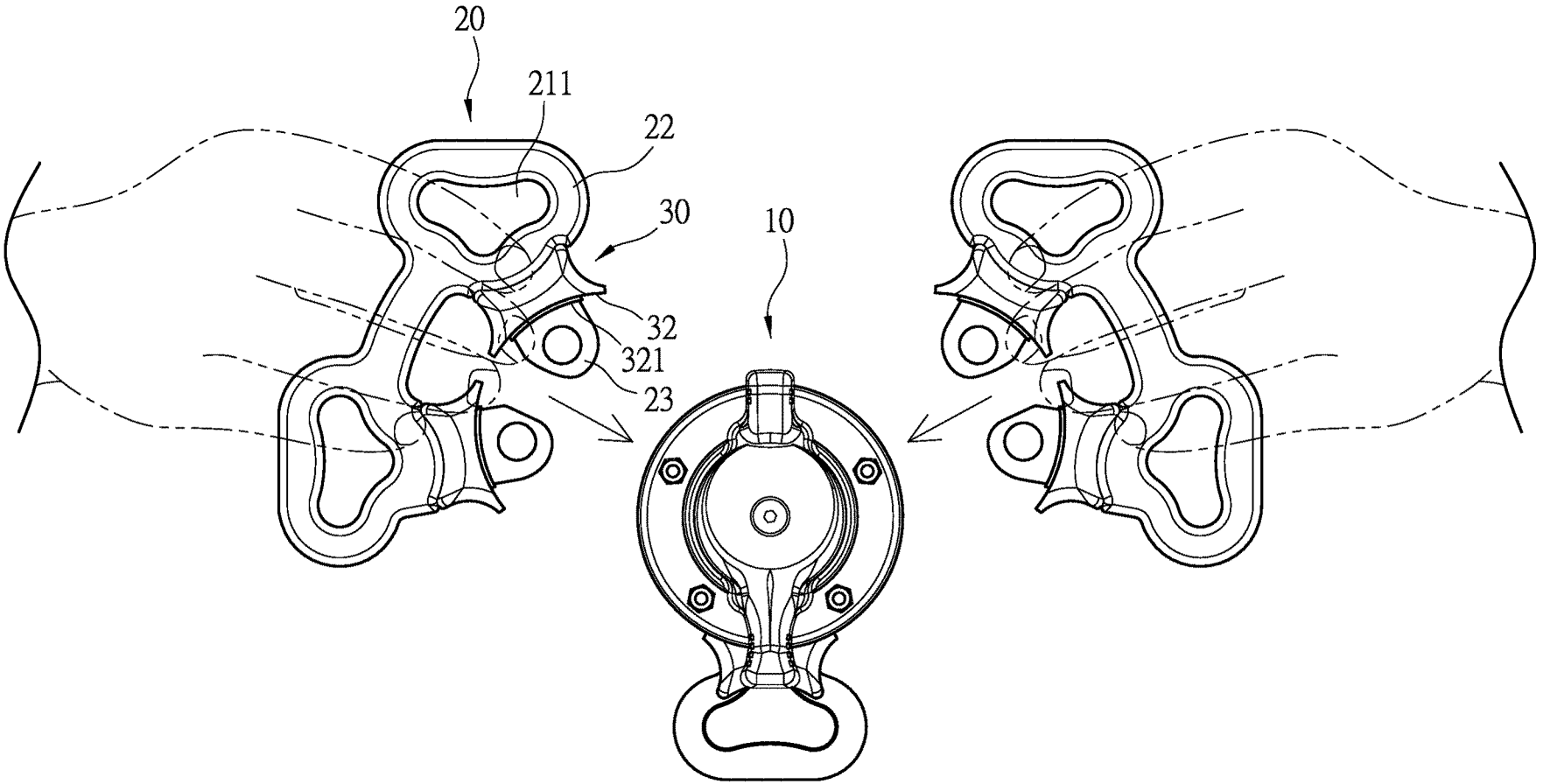
FIG. 4 is a schematic drawing of the latch and the buckle according to the preferred embodiment of the present invention.
Figure 5:
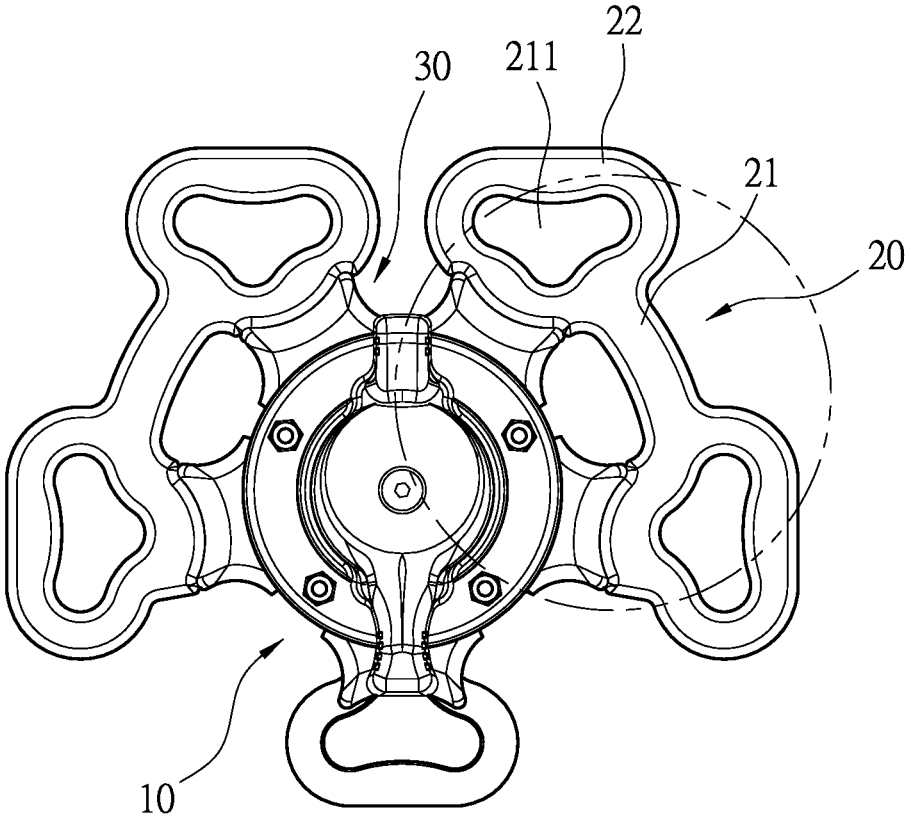
FIG. 5 is a schematic drawing of the latch being inserted into the buckle of the present invention.
Figure 6:
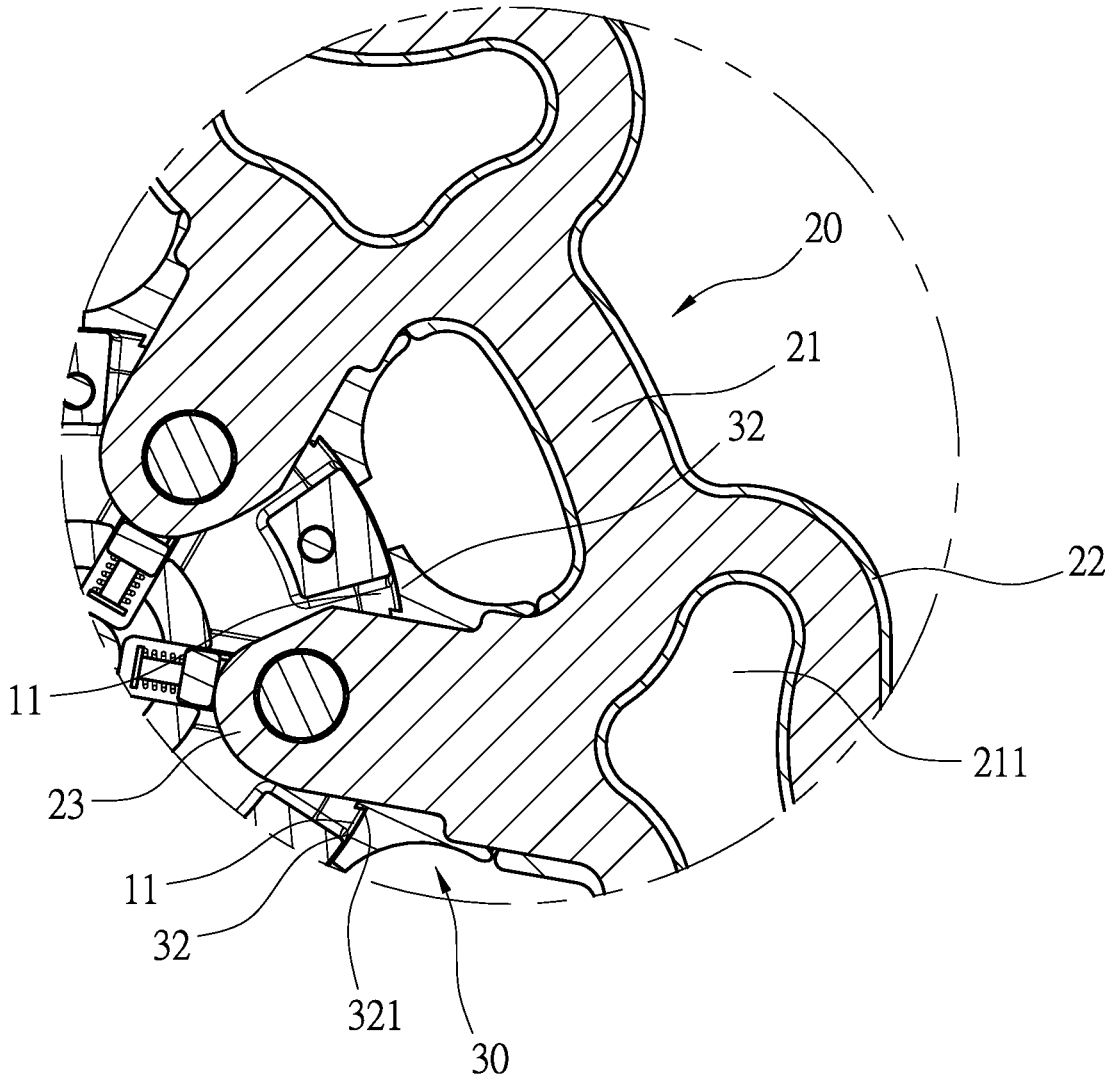
FIG. 6 is a partial enlarged cross-sectional view of the latch being inserted into the buckle the preferred embodiment of the present invention.

First, please refer to FIG. 1 and FIG. 2. A multi-point buckle comprises a buckle 10, at least two latches 20 and a plurality of dust jackets 30. The buckle has a plurality of tongue slots 11 on a peripheral edge, the latch 20 has a handle portion 21 with two belt loops 211, and the handle portion 21 is covered with a plastic layer 22. Each of the latches 20 has at least two tongues 23 at an opposite end corresponding to the two belt loops 211. Each tongue 23 is capable of being inserted into one of the tongue slots 11 of the buckle 10 for locking. Each dust jacket 30 has a through slot 31 through two opposite ends for accepting one of the tongues 23, and one of the two opposite ends of the dust jacket 30 is a first abutting end 32. The first abutting end 32 has a loop lip 321 around an opening of the through slot 31, and another end of dust jacket 30 is a second abutting end 33.

The composition of the structure and the use state, please refer to FIGS. 2 to 6, the latch 20 is sleeved with a dust jacket 30 via the tongue 23, the second abutting end 33 of the dust jacket 30 faces the handle portion 21 and abuts against the plastic layer 22 covered by the handle portion 21. Furthermore, the dust jacket 30 is placed between the tongue 23 and the handle portion 21, and the tongue 23 of the latch 20 is inserted into the tongue slot 11 of the buckle 10 to be locked together. The first abutting end 32 of the dust jacket 30 is pushed against to the buckle 10 when the tongue 23 and the tongue slot 11 are engaged. At the same time, the loop lip 321 of the first abutting end 32 is inserted into the tongue slot 11 and fills the gap between the tongue 23 and the tongue slot 11, which further improves the tightness of the buckle 10 and has the effect of preventing sand and dust from entering into the tongue slot 11.

Figure 7:
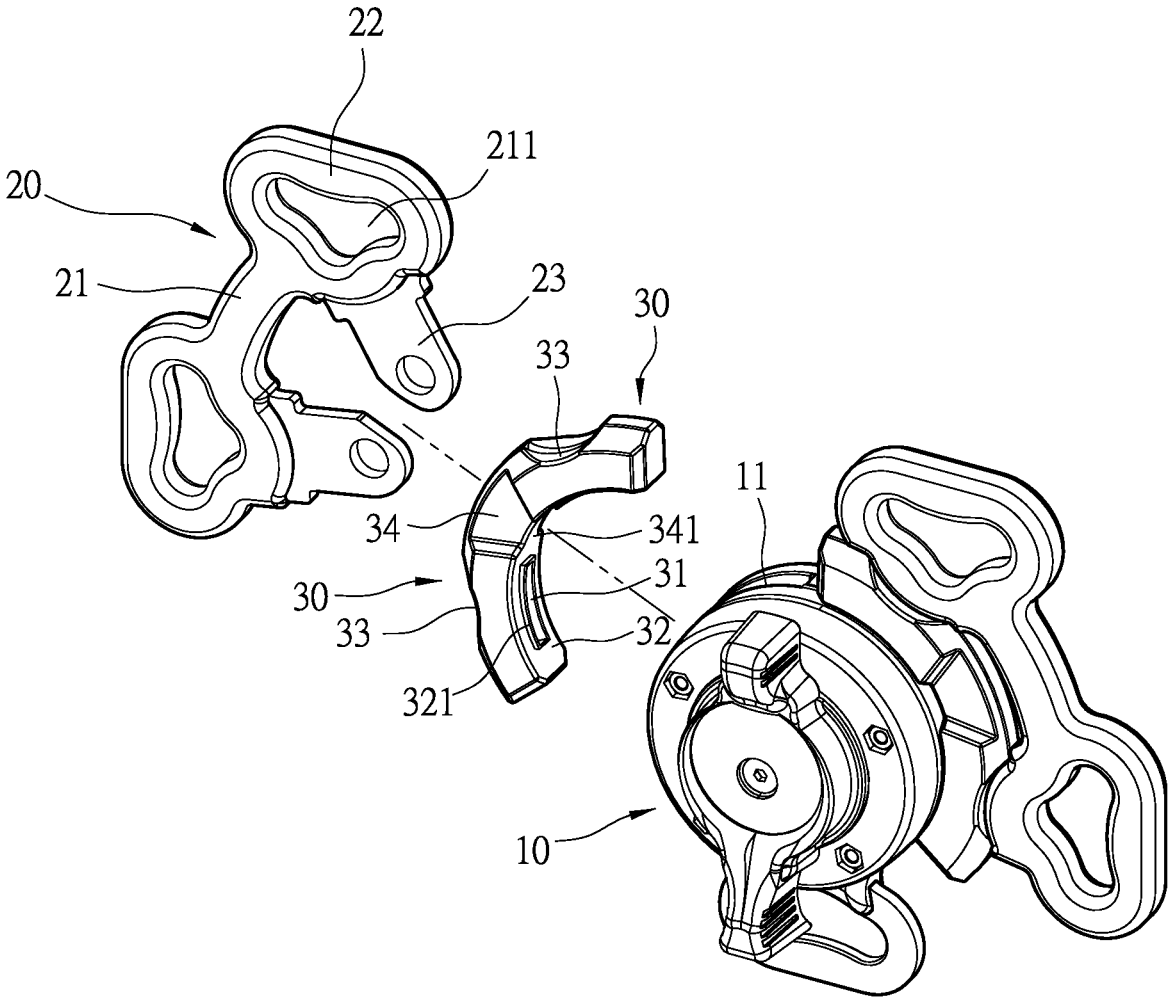
FIG. 7 is an exploded view of another embodiment of the present invention.
Figure 8:
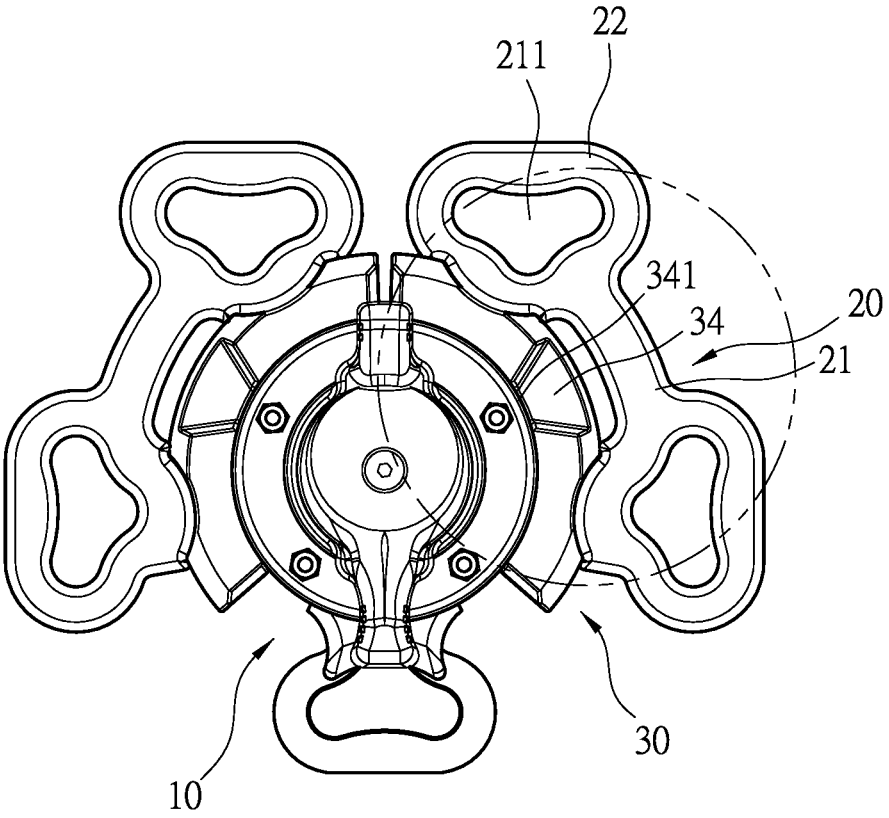
FIG. 8 is a schematic drawing of inserting the latch into the buckle according to another embodiment of the present invention.
Figure 9:
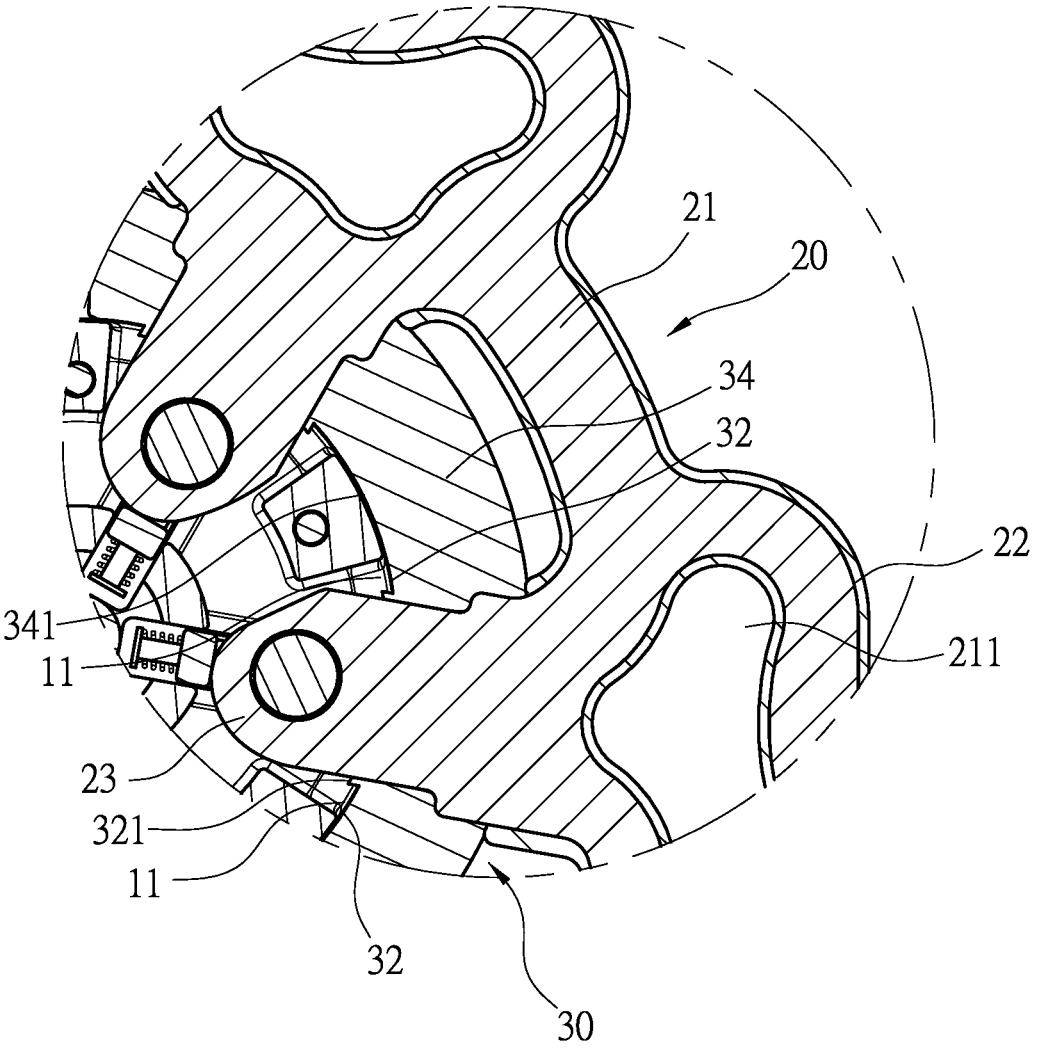
FIG. 9 is a partial enlarged cross-sectional view of another embodiment of the present invention where the latch is inserted into the buckle.

Another embodiment of its structure, as shown in the FIG. 7, FIG. 8, and FIG. 9, the two dust jackets 30 sleeved onto the same latch 20 form are connected together as one curved piece, The two dust jackets 30 are integrally combined by a connecting portion 34, and the first abutting ends 32 of the two dust jackets 30 are connected through the connecting portion 34 to form a bonding surface 341. Accordingly, the integrated two dust jackets 30 utilize the two through slots 31 to sleeve onto the two tongues 23 on the same latch 20. When the latch 20 is inserted into the tongue slot 11 of the buckle 10 with the two tongues 23, the first abutting end 32 is tightly pushed to the periphery of the buckle 10, and the loop lip 321 is embedded in the tongue slot 11, and the connecting part 34 between the two dust jackets 30 is also close to the periphery of the buckle 10 with the fitting surface 341, which greatly improves the dustproof effect between the two tongue slot 11.

With the structure of the above specific embodiment, the following benefits can be obtained: Between the latch 20 and the tongue slot 11 of the buckle 10, the dust jacket 30 is employed to achieve airtight and close the gap, which not only increases the engagement stability between tongue 23 and the tongue slot 11; and at the same time, it can also prevent dust and dirt from falling into the tongue slot 11 to avoid friction and interference of foreign objects, thereby enhancing the safety and value of seat belt buckles.

Although the present invention has been explained in relation to its preferred embodiment, it is to be understood that many other possible modifications and variations can be made without departing from the spirit and scope of invention as hereinafter claimed.

What is claimed is:

1. A multi-point buckle comprising: a buckle, at least two latches and a plurality of dust jackets; the buckle having a plurality of tongue slots on a peripheral edge, each of the latches having at least two tongues, each tongue capable of being inserted into one of the tongue slots of the buckle for locking, characterized in that:

each dust jacket has a through slot through two opposite ends for accepting one of the tongues, one of the two opposite ends of the dust jacket is a first abutting end, the first abutting end abutting an edge of the buckle when the one of the tongues and a corresponding tongue slot are locked together, and the first abutting end has a loop lip around an opening of the through slot for filling in between the tongue and the tongue slot and prevent dust from entering.

2. The multi-point buckle as claimed in claim 1, wherein each latch has a handle portion with two belt loops, and the handle portion is covered with a plastic layer.

3. The multi-point buckle as claimed in claim 2, wherein another end of the dust jacket is a second abutting end with a concave surface, and the second abutting end faces the handle portion and pushes against the plastic layer of the handle portion.

4. The multi-point buckle as claimed in claim 1, wherein the first abutting end of the dust jacket has a concave arc surface.

5. The multi-point buckle as claimed in claim 1, wherein two dust jackets sleeved on a same latch are connected together as one curved piece, a connection portion disposed between the two dust jackets, and the first abutting end of each of the two dust jackets is connected as a fitting surface.

* * * * *